US008198972B2

(12) United States Patent
Akazawa

(10) Patent No.: US 8,198,972 B2
(45) Date of Patent: Jun. 12, 2012

(54) ELECTRONIC COMPONENT

(75) Inventor: Teppei Akazawa, Fukui-ken (JP)

(73) Assignee: Murata Manufacturing Co., Ltd. (JP)

( * ) Notice: Subject to any disclaimer, the term of this patent is extended or adjusted under 35 U.S.C. 154(b) by 18 days.

(21) Appl. No.: 12/898,464

(22) Filed: Oct. 5, 2010

(65) Prior Publication Data

US 2011/0018673 A1 Jan. 27, 2011

Related U.S. Application Data

(63) Continuation of application No. PCT/JP2009/055113, filed on Mar. 17, 2009.

(30) Foreign Application Priority Data

Apr. 8, 2008 (JP) ..... 2008-100302

(51) Int. Cl.
*H01F 5/00* (2006.01)
*H01F 27/28* (2006.01)
*H01F 27/24* (2006.01)

(52) U.S. Cl. ..... 336/200; 336/223; 336/232

(58) Field of Classification Search ..... 336/200, 336/223, 232, 234, 206, 207, 208; 428/209, 428/212, 238, 381, 692.1
See application file for complete search history.

(56) References Cited

U.S. PATENT DOCUMENTS 4,322,698 A * 3/1982 Takahashi et al. ..... 333/184
5,250,923 A * 10/1993 Ushiro et al. ..... 336/83
6,008,157 A * 12/1999 Takeuchi et al. ..... 503/227
6,108,192 A * 8/2000 Sugimoto et al. ..... 361/321.1
6,147,573 A * 11/2000 Kumagai et al. ..... 333/185
6,459,351 B1 * 10/2002 Maki et al. ..... 336/200
6,713,162 B2 * 3/2004 Takaya et al. ..... 428/209
6,879,223 B2 * 4/2005 Park et al. ..... 333/185
6,987,307 B2 * 1/2006 White et al. ..... 257/508
7,304,557 B2 * 12/2007 Tsuzuki et al. ..... 336/200
7,375,609 B2 * 5/2008 Suzuki et al. ..... 336/200

(Continued)

FOREIGN PATENT DOCUMENTS

CN 1282968 C 11/2006

(Continued)

OTHER PUBLICATIONS

International Search Report; PCT/JP2009/055113; Apr. 21, 2009.

(Continued)

*Primary Examiner* — Ahn Mai
*Assistant Examiner* — Joselito Baisa
(74) *Attorney, Agent, or Firm* — Studebaker & Brackett PC; Tim L. Brackett, Jr.; John F. Guay

(57) ABSTRACT

An electronic component includes a coil whose inductance changes in accordance with the magnitude of a current and in which abrupt reduction in the inductance due to magnetic saturation is suppressed. A stack formed by a plurality of stacked first magnetic layers includes a coil formed by coil electrodes connected to one another in the stack. A first nonmagnetic layer is arranged in such a manner as to cut across the coil. When viewed in a stacking direction, a second nonmagnetic layer is formed in a region outside of a region in which the coil is formed. The structure of the second nonmagnetic layer on the upper side of the first nonmagnetic layer in the stacking direction is different from a structure of the second magnetic layer on the lower side of the first nonmagnetic layer in the stacking direction.

10 Claims, 7 Drawing Sheets

U.S. PATENT DOCUMENTS

| | | | | |
|---|---|---|---|---|
| 7,796,401 | B2 * | 9/2010 | Ohmi et al. | 361/782 |
| 7,834,735 | B2 * | 11/2010 | Iwasaki | 336/200 |
| 7,843,701 | B2 * | 11/2010 | Kudo et al. | 361/760 |
| 7,973,631 | B2 * | 7/2011 | Gotsch et al. | 336/200 |
| 7,994,889 | B2 * | 8/2011 | Okabe et al. | 336/200 |

FOREIGN PATENT DOCUMENTS

| | | | |
|---|---|---|---|
| JP | 07-014716 | | 1/1995 |
| JP | 07-201569 | | 8/1995 |
| JP | 2001-044036 | | 2/2001 |
| JP | 2004-311944 | A | 11/2004 |
| JP | 2005-150137 | A | 6/2005 |
| JP | 2006-216916 | A | 8/2006 |
| JP | 2006-318946 | A | 11/2006 |
| JP | 2007-214424 | A | 8/2007 |
| JP | 2008-078229 | A | 4/2008 |

OTHER PUBLICATIONS

Written Opinion of the International Searching Authority; PCT/JP2009/055113; Apr. 21, 2009.

The first Office Action from the Patent Office of the China State Intellectual Property Office dated Jan. 4, 2012; CN Patent Application No. 200980112512.4.

* cited by examiner

ELECTRONIC COMPONENT

CROSS REFERENCE TO RELATED APPLICATIONS

The present application is a continuation of International Application No. PCT/JP2009/055113 filed Mar. 17, 2009, which claims priority to Japanese Patent Application No. 2008-100302 filed Apr. 8, 2008, the entire contents of each of these applications being incorporated herein by reference in their entirety.

TECHNICAL FIELD

The present invention relates to electronic components, and more specifically, to a multilayer electronic component including a coil.

BACKGROUND

Known examples of existing electronic components containing coils include a multilayer inductance device described, for example, in Japanese Unexamined Patent Application Publication No. 2007-214424 (Patent Document 1). The known multilayer inductance device described in Patent Document 1 includes a spiral coil conductor made up of internal conductors, a first nonmagnetic layer arranged in such a manner as to be perpendicular to the coil axis of the coil, and second nonmagnetic layers arranged between the internal conductors.

According to the known multilayer inductance device, the coil has an open-magnetic-path structure because the first nonmagnetic layer is arranged in such a manner as to cut across the coil. As a result, abrupt reduction in inductance due to magnetic saturation is unlikely to occur even when a current of the multilayer inductance device is increased. In other words, the direct current (DC) superposition characteristics of the multilayer inductance device are improved.

Meanwhile, there is a case in DC-to-DC converters requiring different inductances of a coil for a low-output-current region and a high-output-current region. More specifically, in an electronic component including a coil used for DC-to-DC converters, DC superposition characteristics are required which allow realization of a relatively high inductance in a low-output-current region and a relatively low inductance in a high-output-current region.

However, because the multilayer inductance device described in Patent Document 1 maintains an approximately constant inductance even when the current increases, it is hard to obtain the DC superposition characteristics suitable for DC-to-DC converters described above.

SUMMARY

Embodiments consistent with the invention provide an electronic component that includes a coil whose inductance changes in accordance with the magnitude of a current and can suppress an abrupt decrease in the inductance due to magnetic saturation.

An embodiment of an electronic component consistent with the claimed invention includes a stack of a plurality of first insulator layers, a plurality of coil electrodes connected to one another in the stack to form a coil, a second insulator layer that is arranged in such a manner as to cut across the coil and that has a permeability lower than that of the first insulator layers, and a third insulator layer that is, when viewed in a stacking direction, formed in a region outside of a region in which the coil is formed, and that has a permeability lower than that of the first insulator layer. A structure of the third insulator layer on the upper side of the second insulator in the stacking direction is different from a structure of the third insulator layer on the lower side of the second insulator in the stacking direction.

Other features, elements, characteristics and advantages of the present invention will become more apparent from the following detailed description of preferred embodiments of the present invention (with reference to the attached drawings).

DETAILED DESCRIPTION

Figure 1A:
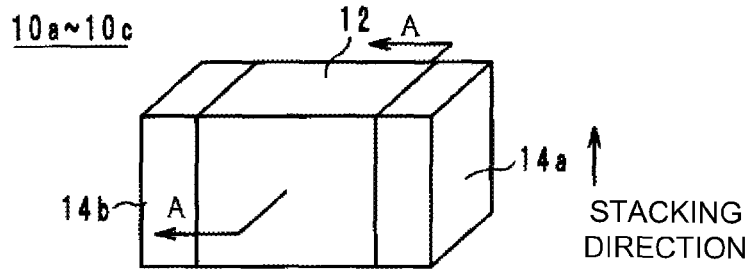
FIG. 1A is an external perspective view of an electronic component according to an exemplary embodiment.
Figure 1B:
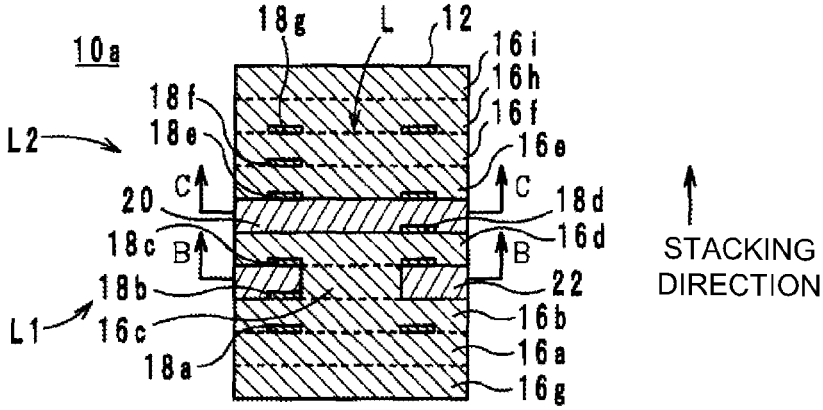
FIG. 1B is a sectional structure diagram taken along the line A-A of the electronic component illustrated in FIG. 1A.
Figure 1C:
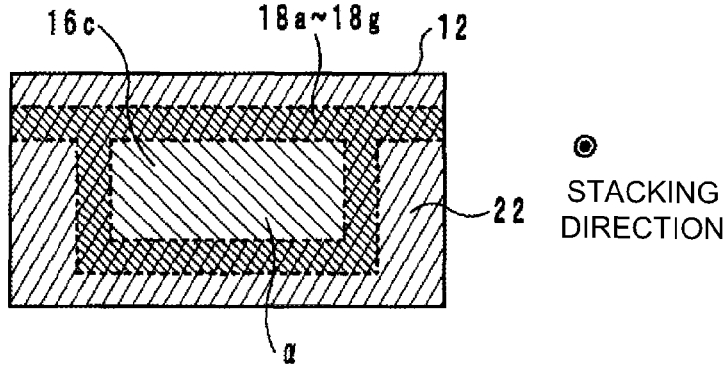
FIG. 1C is a sectional structure diagram taken along the line B-B of the electronic component illustrated in FIG. 1B.
Figure 1D:
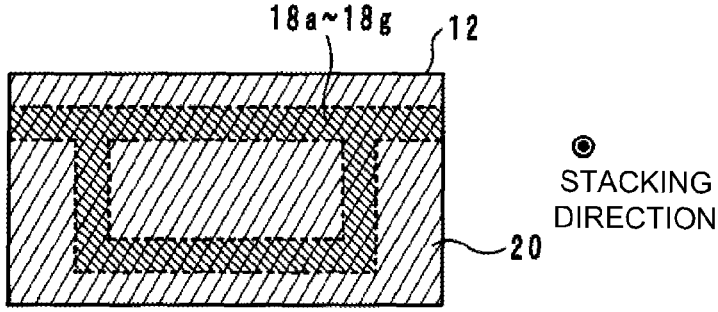
FIG. 1D is a sectional structure diagram taken along the line C-C of the electronic component illustrated in FIG. 1C.

Hereinafter, description will be made of an electronic component according to exemplary embodiments. FIG. 1A is an external perspective view of an exemplary electronic component 10*a*. FIG. 1B is a sectional structure diagram taken along the line A-A of the electronic component 10*a*. FIG. 1C is a sectional structure diagram taken along the line B-B of the electronic component 10*a*. FIG. 1D is a sectional structure diagram taken along the line C-C of the electronic component 10*a*. Hereinafter, a stacking direction is defined as a direction in which insulator layers are stacked at the time of forming the electronic component 10*a*. In FIG. 1C and FIG. 1D, dotted lines represent outlines of coil electrodes 18*a* to 18*g* of the electronic component 10*a*. In FIG. 1B, although boundary lines of the respective layers are represented by dotted lines, there is a case in which no visible boundary line exists.

Referring now to FIG. 1A, the electronic component 10*a* includes a rectangular-parallelepiped-shaped stack 12 having a coil therein and two external electrodes 14*a* and 14*b* formed on the sides of the stack 12 opposite each other.

The stack 12 can be formed by stacking a plurality of electrodes and a plurality of magnetic layers, as described below. Referring to FIG. 1B, the stack 12 is formed by stacking a plurality of insulator layers (magnetic layers 16*a* to 16*i*) made of ferromagnetic ferrite (for example, Ni—Zn—Cu ferrite or Ni—Zn ferrite) and insulator layers (nonmagnetic layers) 20 and 22 made of a material having a lower permeability than the magnetic layers 16*a* to 16*i*. In the present embodiment, the insulator layers (i.e., nonmagnetic layers) 20 and 22 made of a material having a lower permeability than the magnetic layers 16*a* to 16*i* can have a permeability of 1, for example.

The magnetic layers 16*a*, 16*b*, and 16*d* to 16*i* and the nonmagnetic layer 20 are rectangular-shaped layers. Referring to FIG. 1C, the nonmagnetic layer 22 is a frame-shaped layer whose center portion has been cut out in the shape of a rectangle. The magnetic layer 16*c* is a layer having a shape that matches the center portion of the nonmagnetic layer 22 cut out in the shape of a rectangle, as illustrated in FIG. 1C.

The coil electrodes 18*a* to 18*g* which constitute a coil L by being connected to one another in the stack 12 are respectively formed on the main surfaces of the magnetic layers 16*a* and 16*b*, the nonmagnetic layer 22, the magnetic layer 16*d*, the nonmagnetic layer 20, and the magnetic layers 16*e* and 16*f*. Referring to FIG. 1B, the magnetic layers 16*g*, 16*a*, 16*b*, and 16*c*, the nonmagnetic layer 22, the magnetic layer 16*d*, the nonmagnetic layer 20, and the magnetic layers 16*e*, 16*f*, 16*h*, and 16*i* are stacked in this order from the lower side. Hereinafter, the individual magnetic layers 16*a* to 16*i* and the coil electrodes 18*a* to 18*g* are denoted by reference numerals followed by letters of the alphabet and are collectively denoted by reference numerals without letters of the alphabet.

The coil electrodes 18 are made of a conductive material composed of Ag, and are U-shaped. Hence, each of the coil electrodes 18 constitutes a portion of the coil L, corresponding to a ¾ turn. Note that the coil electrodes 18 may be made of a conductive material mainly composed of a noble metal such as Pd, Au, or Pt, or an alloy thereof. Also note that each of the coil electrodes 18 need not constitute a ¾ turn of the coil, and thus may be more or less than ¾ turn.

The coil electrodes 18 are connected to one another to form the spiral coil L. The coil electrodes 18*a* and 18*g* respectively formed on the lowermost and uppermost sides in the stacking direction are connected respectively to the external electrodes 14*a* and 14*b*.

Furthermore, the plurality of the coil electrodes 18 together form the shape of a frame in plan view when viewed from the upper side in the stacking direction, as illustrated in FIG. 1C. When viewed in the stacking direction, the nonmagnetic layer 22 is formed in a region outside of a region α (inside of the shape of the frame in FIG. 1C) surrounded by the coil electrodes 18. In other words, the nonmagnetic layer 22 is formed in a region overlapping the coil electrodes 18*b* and 18*c* in the stacking direction, as illustrated in FIG. 1B, and in a region (called a side gap) outside of a region where the coil electrodes 18 are formed, as illustrated in FIG. 1C. In addition, the magnetic layer 16*c* is formed at a position that is the same as the position of the nonmagnetic layer 22 in the stacking direction and within the region α.

Referring to FIG. 1D, the nonmagnetic layer 20 is formed on the whole area of a section perpendicular to the stacking direction in such a manner as to cut across the coil L in a direction perpendicular to the stacking direction. As a result of the nonmagnetic layers 20 and 22 having the structures illustrated in FIG. 1B, the structure of the nonmagnetic layer 22 on the upper side of the nonmagnetic layer 20 in the stacking direction is different from the structure of the nonmagnetic layer 22 on the lower side of the nonmagnetic layer 20 in the stacking direction. More specifically, the nonmagnetic layer 22 is not provided on the upper side of the nonmagnetic layer 20 and the nonmagnetic layer 22 is provided on the lower side of the nonmagnetic layer 20, in the stacking direction. Note that the phrase "the structure of the nonmagnetic layer 22" refers to the position, the shape, and the number of the nonmagnetic layers 22.

The electronic component 10*a* can be obtained by forming the stack 12 by stacking the magnetic layers 16, the coil electrodes 18, and the nonmagnetic layers 20 and 22, configured as described above, in the stacking direction, and by forming the external electrodes 14*a* and 14*b*.

In the electronic component 10*a*, DC superposition characteristics can be improved, as will be described below. Specifically, the electronic component 10*a* is provided with the nonmagnetic layer 20. Accordingly, the coil L constitutes an open-magnetic-path coil. Hence, occurrence of magnetic saturation can be suppressed in the electronic component 10*a*, and the DC superposition characteristics of the electronic component 10*a* can be improved.

Figure 2:
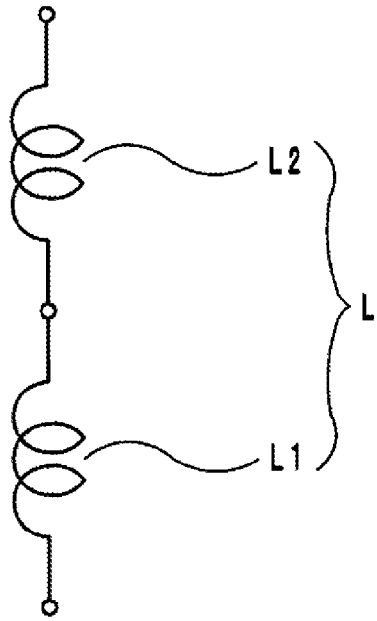
FIG. 2 is an equivalent circuit diagram of the electronic component illustrated in FIGS. 1A to 1D.
Figure 3:
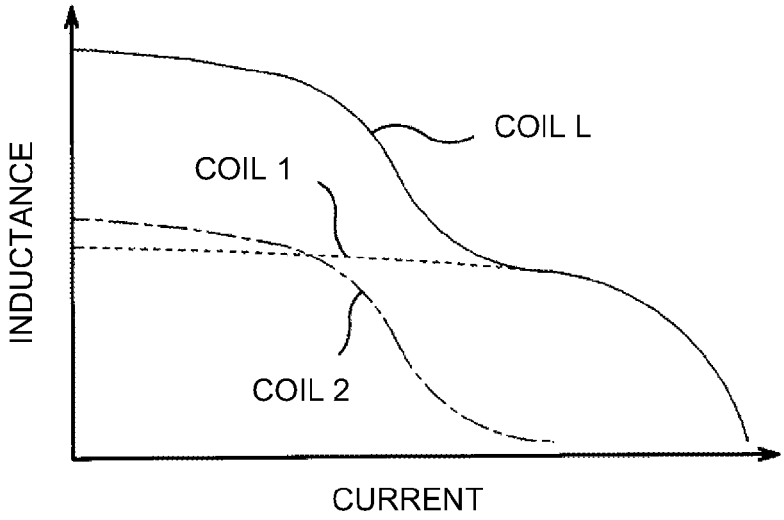
FIG. 3 is a graph illustrating the DC superposition characteristics of the electronic component illustrated in FIGS. 1A to 1D.

In addition, the electronic component 10*a* obtains an inductance that can change in accordance with the magnitude of a current, as will be described below with reference to the drawings. FIG. 2 is an equivalent circuit diagram of the electronic component 10*a*. FIG. 3 is a graph illustrating the DC superposition characteristics of the electronic component 10*a*. The vertical axis represents inductance, and the horizontal axis represents current.

Referring to FIG. 1B, the nonmagnetic layer 20 is formed, or provided in such a manner as to cut across the coil L near the center of the coil L in the stacking direction. The coil L having this configuration can be considered a coil L1 connected in series with a coil L2, as illustrated in FIG. 2. The coil L1 is a coil constituted by the coil electrodes 18*a* to 18*d* located on the lower side of the nonmagnetic layer 20, while the coil L2 is a coil constituted by the coil electrodes 18*e* to 18*g* located on the upper side of the nonmagnetic layer 20.

Since the coil L1 is provided with the nonmagnetic layer 22 as illustrated in FIG. 1B, the coil L1 forms an open-magnetic-path coil. Hence, as illustrated by the dotted line in FIG. 3, it is not until a relatively high current flows that the inductance of the coil L1 decreases abruptly. On the other hand, since the coil L2 is not provided with the nonmagnetic layer 22, as illustrated in FIG. 1B, the coil L2 forms a closed-magnetic-path coil. Hence, the inductance of the coil L2 abruptly decreases even when a relatively low current flows, as illustrated by the one-dot chain line in FIG. 3. In other words, in the electronic component 10*a*, by making the structure of the nonmagnetic layer 22 on the upper side of the nonmagnetic layer 20 in the stacking direction different from the structure of the nonmagnetic layer 22 on the lower side of the nonmagnetic layer 20 in the stacking direction, the DC superposition characteristics of the coil L1 are made to be different from the DC superposition characteristics of the coil L2.

Here, the inductance of the coil L in which the coils L1 and 12 are connected in series to one another is represented by the sum of the inductance of the coil L1 and the inductance of the coil L2. In other words, the DC superposition characteristics of the coil L are represented by a curved line obtained by adding the dotted line and the one-dot chain line in FIG. 3. Hence, in the DC superposition characteristics of the coil L, the inductance decreases stepwise as the current increases as illustrated by the solid line in FIG. 3. In more detail, the coil L has a relatively high inductance when a relatively low current flows through the coil L, and a relatively low inductance when a relatively high current flows through the coil L.

Coils used for DC-to-DC converters require a relatively high inductance in a low-output-current region and a relatively low inductance in a high-output-current region. Hence, the electronic component 10*a* can be applied to DC-to-DC converters.

Figure 4A:
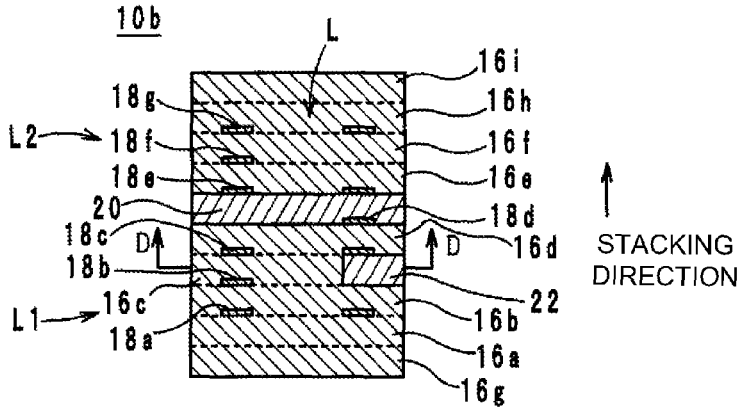
FIG. 4A is a sectional structure diagram of an electronic component according to a first exemplary modification.
Figure 4B:
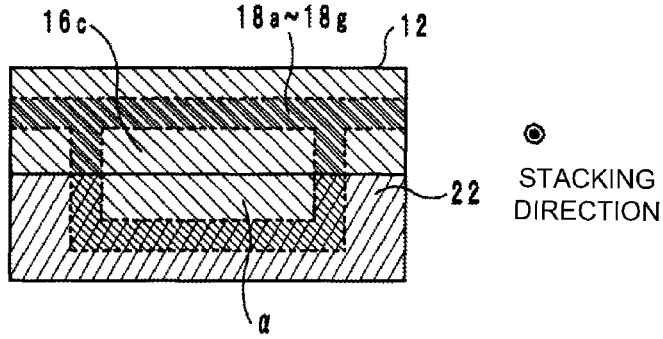
FIG. 4B is a sectional structure diagram taken along the line D-D of the electronic component illustrated in FIG. 4A.
Figure 5:
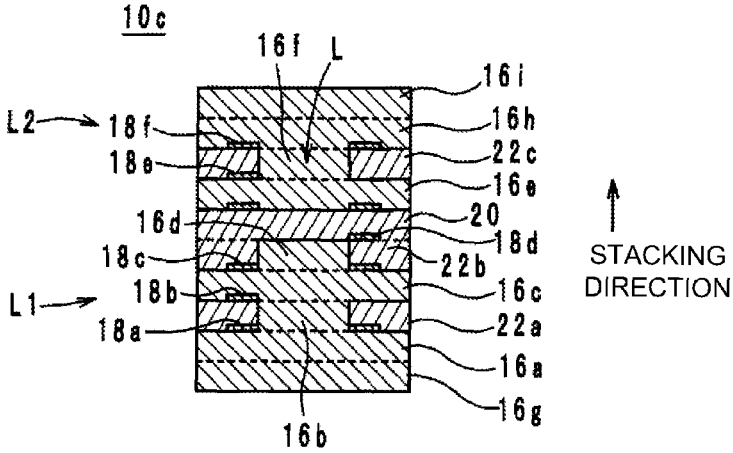
FIG. 5 is a sectional structure diagram of an electronic component according to a second exemplary modification.

The structure of an electronic component according to an embodiment of the present invention is not limited to the structure of the exemplary electronic component 10*a*. More specifically, the structures of the nonmagnetic layers 20 and 22 are not limited to the structures illustrated in FIGS. 1B-1D. The nonmagnetic layers 20 and 22 are only required to have structures which allow the coil L1 and the coil L2 to have different DC superposition characteristics. Hereinafter, structures of the nonmagnetic layers 20 and 22 for allowing the coil L1 and the coil L2 to have different DC superposition characteristics will be described with reference to the drawings. FIG. 4A is a sectional structure diagram of an electronic component 10*b* according to a first exemplary modification. FIG. 4B is a sectional structure diagram taken along the line D-D of the electronic component 10*b*. FIG. 5 is a sectional structure diagram of an electronic component 10*c* according to a second exemplary modification.

In the exemplary electronic component 10*a* illustrated in FIG. 1B and FIG. 1C, the nonmagnetic layer 22 is frame-shaped. On the other hand, in the exemplary electronic component 10*b* illustrated in FIG. 4A and FIG. 4B, a nonmagnetic layer 22 is U-shaped. Also in the nonmagnetic layer 22 having this structure, the structure of the nonmagnetic layer 22 on the upper side of the nonmagnetic layer 20 in the stacking direction is different from the structure of the nonmagnetic layer 22 on the lower side of the nonmagnetic layer 20 in the stacking direction. Hence, the coil L1 and the coil L2 of the exemplary electronic component 10*b* can have different DC superposition characteristics.

In the electronic component 10*a* illustrated in FIG. 1B and FIG. 1C, the nonmagnetic layer 22 (a single layer) is provided on the lower side of the nonmagnetic layer 20 in the stacking direction. On the other hand, in the electronic component 10*c* illustrated in FIG. 5, a nonmagnetic layer 22*c* is provided on the upper side of the nonmagnetic layer 20 in the stacking direction, and two nonmagnetic layers 22*a* and 22*b* are provided on the lower side of the nonmagnetic layer 20 in the stacking direction. Also, in the nonmagnetic layers 22 including the nonmagnetic layers 22*a*, 22*b*, and 22*c* having such structures, the structure of the nonmagnetic layers 22 on the upper side of the nonmagnetic layer 20 in the stacking direction is different from the structure of the nonmagnetic layers 22 on the lower side of the nonmagnetic layer 20 in the stacking direction. As a result, the coil L1 and the coil L2 have different DC superposition characteristics.

Hereinafter described is an exemplary method of manufacturing the electronic component 10*a*, as an example of the methods of manufacturing the electronic components 10*a* to 10*c*. FIGS. 6A to 9 are plan views and sectional structure diagrams illustrating manufacturing process steps for manufacturing the electronic component 10*a*. While it would be likely that a plurality of the electronic components 10*a* are manufactured at a time, for simplicity of description an exemplary method of manufacturing one of the exemplary electronic components 10*a* will be described below.

Ceramic green sheets 116*a*, 116*g*, 116*h*, and 116*i* in FIGS. 6A to 9 represent sheets or layers of the magnetic layers 16*a* 16*g*, 16*h*, and 16*i* in FIG. 1B in a yet-to-be-sintered state. Hereinafter, when the ceramic green sheets 116*a*, 116*g*, 116*h*, and 116*i* are collectively referred to, letters of the alphabet following the reference numerals are omitted, and reference numerals followed by letters of the alphabet are used for referring to the individual ceramic green sheets 116.

The ceramic green sheets 116 can be manufactured as follows. Materials: ferric oxide ($Fe_2O_3$), zinc oxide (ZnO), nickel oxide (NiO), and copper oxide (CuO), having amounts in a predetermined ratio are prepared and put in a ball mill, and then wet mixing is performed. The obtained mixture is dried and ground, and then the obtained powder is calcined at 750° C. for one hour. The obtained calcined powder is wet-ground using a ball mill, dried, and crushed, whereby ferrite ceramic powder is obtained.

This ferrite ceramic powder is mixed with a binder (such as vinyl acetate or water-soluble acryl), a flexibilizer, a wetting agent, and a dispersing agent using a ball mill, and then air-releasing is performed through decompression. The obtained ceramic slurry is formed into sheets using a doctor blade method and dried, whereby the ceramic green sheets 116 having a desired width (for example, 35 μm) are manufactured.

Figures 6A, 6B, 6C, 6D, 6E:
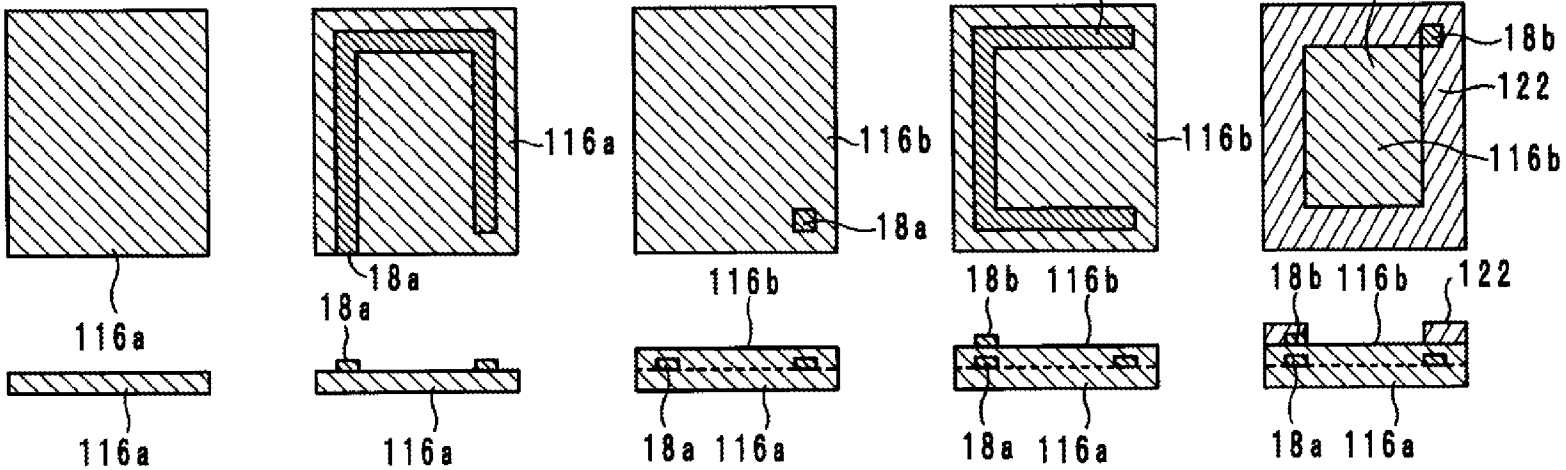
FIGS. 6A to 6E are plan views and sectional structure diagrams illustrating exemplary manufacturing process steps for manufacturing an electronic component.

First, the manufactured ceramic green sheet 116*a* (one sheet) is prepared, as illustrated in FIG. 6A. Then, as illustrated in FIG. 6B, the coil electrode 18*a* is formed on the ceramic green sheet 116*a* by applying an electrically conductive paste to the ceramic green sheet 116*a* using, for example, screen printing or lithography. The coil electrode 18*a* can be formed using Ag, Pd, Cu, Au, or an alloy thereof, in such a manner as to be U-shaped.

Next, a ferrite paste is printed on the ceramic green sheet 116*a* using screen printing, as illustrated in FIG. 6C, thereby forming a printed layer 116*b*, which will become the magnetic layer 16*b*. This ferrite paste is made of the same material as the ceramic green sheet 116*a*. At this time, the printed layer 116*b* is formed such that an end of the coil electrode 18*a* which is not at the connection of the coil electrode 18*a* to the external electrode 14*a* is exposed above the printed layer 116*b* (see the plan view of FIG. 6C). Thus, the exposed end of electrode 18*a* forms a connection portion for connecting the coil electrode 18*a* to the coil electrode 18*b*.

Next, the U-shaped coil electrode 18*b* is formed on the printed layer 116*b* by applying a conductive paste to the printed layer 116*b* using, for example, screen printing or lithography, as illustrated in FIG. 6D. The coil electrode 18*b* is formed such that an end thereof is positioned at the portion of the coil electrode 18*a* exposed above the printed layer 116*b*. Thus, the coil electrode 18*a* and the coil electrode 18*b* are connected to each other.

Next, a printed layer 122, which will become the nonmagnetic layer 22, is formed on the ceramic green sheet 116*b* by printing a nonmagnetic paste on the printed layer 116*b* using screen printing, for example, as illustrated in FIG. 6E. This nonmagnetic paste is obtained by mixing ferric oxide ($Fe_2O_3$), zinc oxide (ZnO), and copper oxide (CuO) in a predetermined ratio. The printed layer 122 is formed in such a manner as to surround the region α when viewed in the stacking direction, as illustrated in FIG. 1C. Hence, the printed layer 122 is formed in the shape of a frame. Furthermore, the printed layer 122 is formed such that an end of the coil electrode 18*b* which is not at the connection of the coil electrode 18*b* to the coil electrode 18*a* is exposed above the printed layer 122 (see the plan view of FIG. 6E). Thus, the exposed end of the coil electrode 18*b* forms a connection portion for connecting the coil electrode 18*b* to the coil electrode 18*c*.

Figures 7A, 7B, 7C, 7D, 7E:
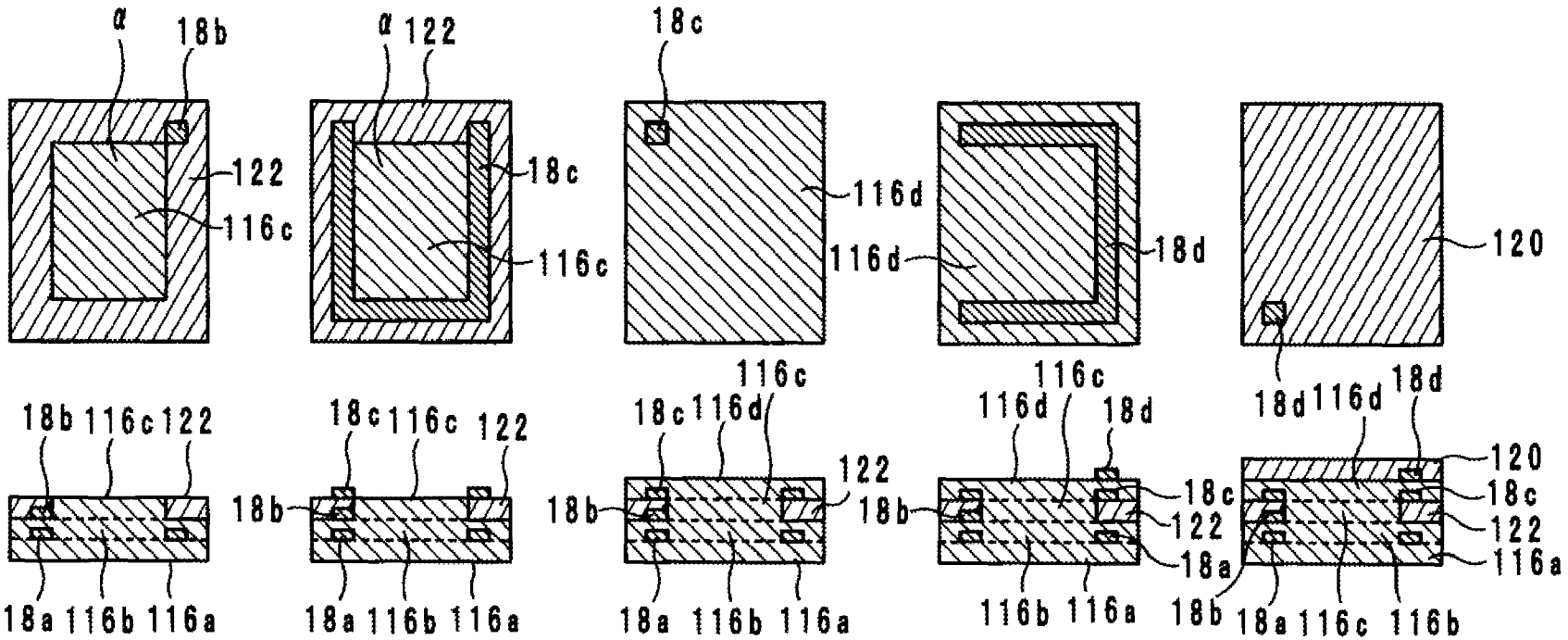
FIGS. 7A to 7E are plan views and sectional structure diagrams illustrating exemplary manufacturing process steps for manufacturing an electronic component.

Next, a printed layer 116*c*, which will become the magnetic layer 16*c*, is formed in the region a on the ceramic green sheet 116*b* by printing a ferrite paste on the printed layer 116*b* using screen printing, for example, as illustrated in FIG. 7A. This ferrite paste is made of the same material as the ceramic green sheet 116*a*.

Next, the U-shaped coil electrode 18*c* is formed on the printed layer 122 by applying a conductive paste to the printed layer 122 using screen printing or lithography, for example, as illustrated in FIG. 7B. The coil electrode 18*c* is formed such that an end thereof is positioned at the portion of the coil electrode 18*b* exposed above the printed layer 122. Thus, the coil electrode 18*b* and the coil electrode 18*c* are connected to each other.

Next, a printed layer 116*d*, which will become the magnetic layer 16*d*, is formed on the printed layers 116*c* and 122 by printing a ferrite paste on the printed layers 116*c* and 122 using screen printing, for example, as illustrated in FIG. 7C. This ferrite paste is made of the same material as the ceramic green sheet 116*a*. At this time, the printed layer 116*b* is formed such that an end of the coil electrode 18*c*, which is not at the connection of the coil electrode 18*c* to the coil electrode 18*b*, is exposed above the printed layer 116*d* (see the plan view of FIG. 7*c*). Thus, a connection portion for connecting the coil electrode 18*c* to the coil electrode 18*d* is formed.

Next, the U-shaped coil electrode 18*d* is formed on the printed layer 116*d* by applying a conductive paste on the printed layer 116*d* using screen printing or lithography, for example, as illustrated in FIG. 7D. The coil electrode 18*d* is formed such that an end thereof is positioned at the portion of the coil electrode 18*c* exposed above the printed layer 116*d*. Thus, the coil electrode 18*c* and the coil electrode 18*d* are connected to each other.

Next, a printed layer 120, which will become the nonmagnetic layer 20, is formed on the printed layer 116*d* by printing a nonmagnetic paste on the printed layer 116*d* using screen printing, as illustrated in FIG. 7E. This nonmagnetic paste is made of the same material as the printed layer 122. At this time, the printed layer 120 is formed such that an end of the coil electrode 18*d*, which is not at the connection of the coil electrode 18*d* to the coil electrode 18*c*, is exposed above the printed layer 120. Thus, the exposed end of the coil electrode 18*d* forms a connection portion for connecting the coil electrode 18*d* to the coil electrode 18*e*.

Figures 8A, 8B, 8C, 8D, 8E:
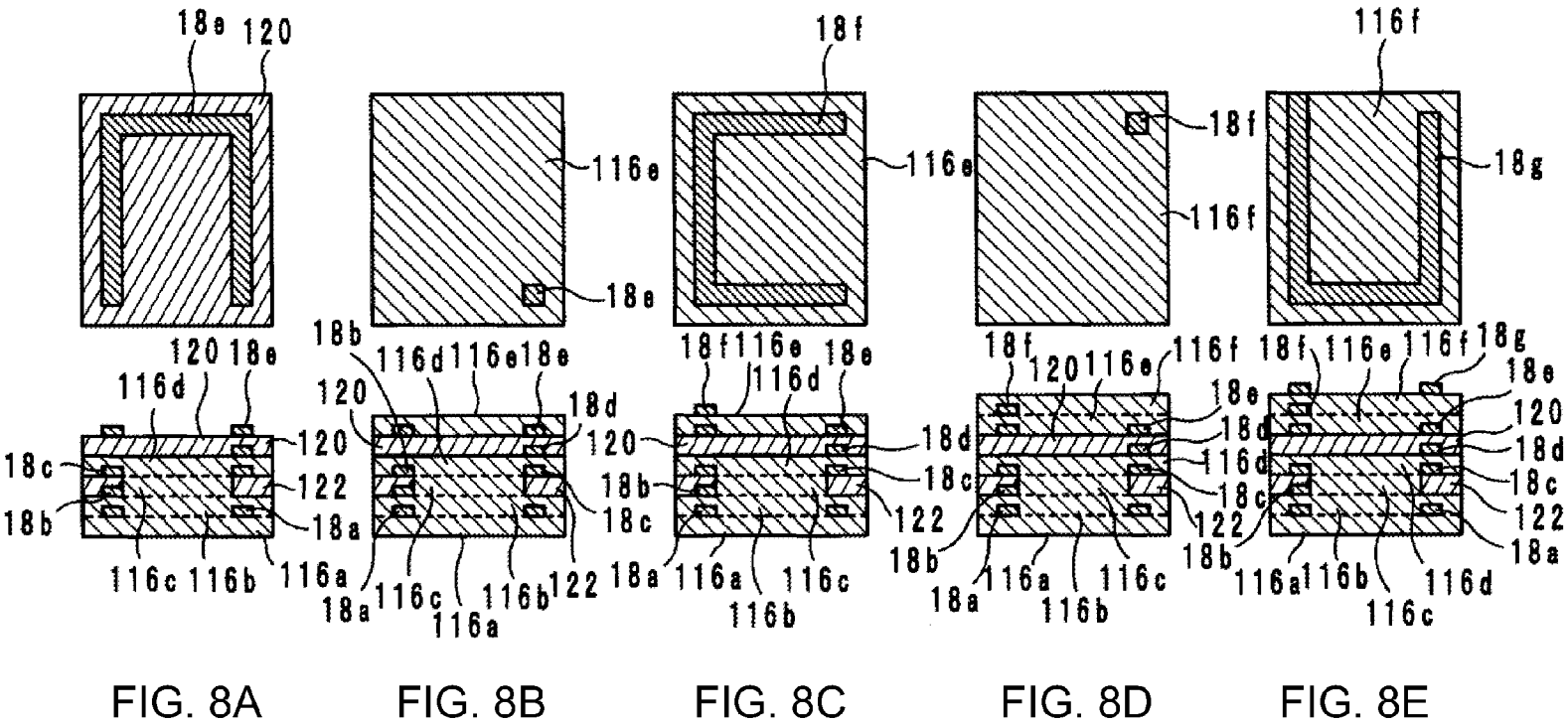
FIGS. 8A to 8E are plan views and sectional structure diagrams illustrating exemplary manufacturing process steps for manufacturing an electronic component.

Next, the U-shaped coil electrode 18*e* is formed on the printed layer 120 by applying a conductive paste to the printed layer 120 using screen printing or lithography, for example, as illustrated in FIG. 8A. The coil electrode 18*e* is formed such that an end thereof is positioned at the portion of the coil electrode 18*d* exposed above the printed layer 120. Thus, the coil electrode 18*d* and the coil electrode 18*e* are connected to each other.

Next, a printed layer 116*e*, which will become the magnetic layer 16*e*, is formed on the printed layer 120 by printing a ferrite paste on the printed layer 120 using screen printing, for example, as illustrated in FIG. 8B. This ferrite paste is made of the same material as the ceramic green sheet 116*a*. At this time, the printed layer 116*e* is formed such that an end of the coil electrode 18*e*, which is not at the connection of the coil electrode 18*e* and the coil electrode 18*d*, is exposed above the printed layer 116*e* (see the plan view of FIG. 8B). Thus, the exposed end of the coil electrode 18*e* forms a connection portion for connecting the coil electrode 18*e* to the coil electrode 18*f*.

Next, the U-shaped coil electrode 18*f* is formed on the printed layer 116*e* by applying a conductive paste to the printed layer 116*e* using screen printing or lithography, for example, as illustrated in FIG. 8C. The coil electrode 18*f* is formed such that an end thereof is positioned at the portion of the coil electrode 18*e* exposed above the printed layer 116*e*. Thus, the coil electrode 18*e* and the coil electrode 18*f* are connected to each other.

Next, a printed layer 116*f*, which will become the magnetic layer 16*f*, is formed on the printed layer 116*e* by printing a ferrite paste on the printed layer 116*e* using screen printing, as illustrated in FIG. 8D. This ferrite paste is made of the same material as the ceramic green sheet 116*a*. At this time, the printed layer 116*f* is formed such that an end of the coil electrode 18*f*, which is not at the connection of the coil electrode 18*f* and the coil electrode 18*e* is exposed above the printed layer 116*f*. Thus, the exposed end of the coil electrode 18*f* forms a connection portion for connecting the coil electrode 18*f* to the coil electrode 18*g*.

Next, the U-shaped coil electrode 18*g* is formed on the printed layer 116*f* by applying a conductive paste to the printed layer 116*f* using screen printing or lithography, for example, as illustrated in FIG. 8E. The coil electrode 18*g* is formed such that an end thereof is positioned at the portion of the coil electrode 18*f* exposed above the printed layer 116*f*. Thus, the coil electrode 18*f* and the coil electrode 18*g* are connected to each other.

Figure 9:
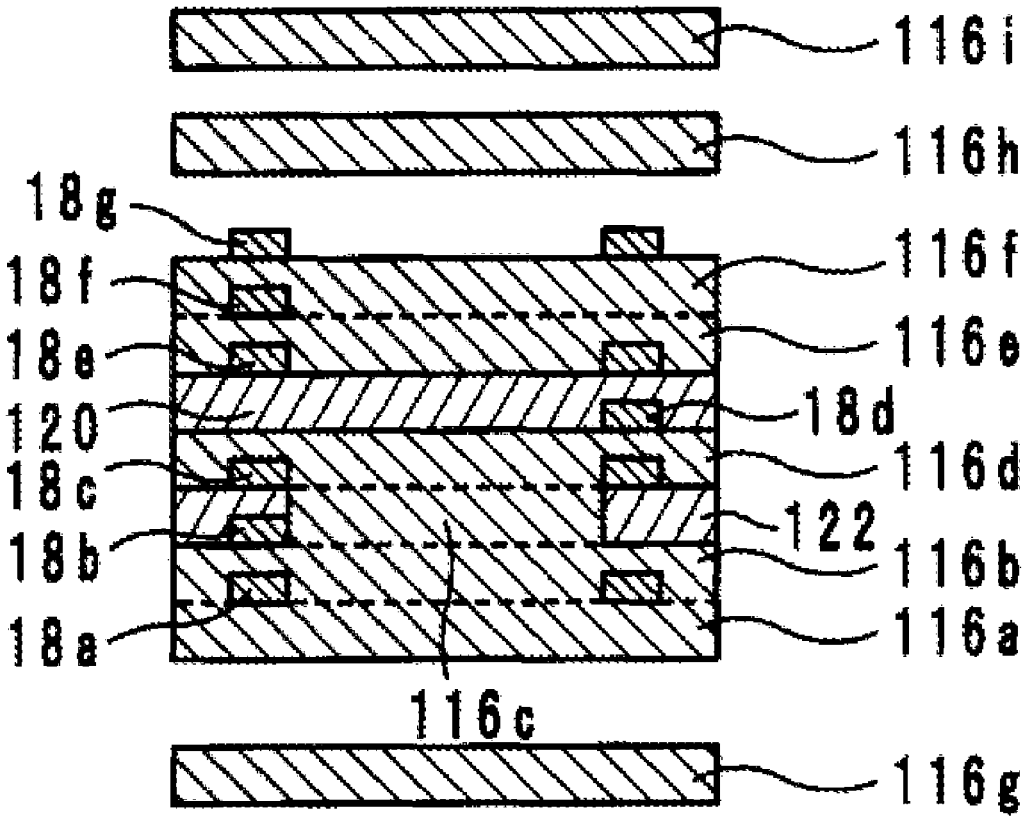
FIG. 9 is a sectional structure diagram illustrating exemplary manufacturing process steps for manufacturing an electronic component.

Next, referring to FIG. 9, the ceramic green sheet 116*g* corresponding to one layer is stacked and fixed by pressure, using a sheet stacking method, to the bottom of the stack thus obtained through the process steps in FIGS. 6A to 8E, and the ceramic green sheets 116*h* and 116*i* corresponding to two layers are stacked and fixed by pressure to the top of the stack using a sheet stacking method. Thus, the stack 12 to be sintered having the sectional structure illustrated in FIG. 1B is obtained. The stack 12 to be sintered is subjected to a binder removing process and sintered. The sintering temperature is, for example, 900° C. Thus, the sintered stack 12 is obtained.

Next, the external electrodes 14*a* and 14*b* are formed on the stack 12, by applying to the stack 12 an electrode paste mainly composed of silver using, for example, an immersion method and sintering. Referring to FIG. 1A, the external electrodes 14*a* and 14*b* are formed on the left and right sides of the stack 12.

Finally, the surfaces of the external electrodes 14 are plated using Ni/Sn. Through these process steps described above, the electronic component 10*a* illustrated in FIGS. 1A to 1D is manufactured.

Note that, although the electronic component 10*a* is manufactured using a combination of printing and sheet-stacking methods, according to the manufacturing method described above, the method of manufacturing the electronic component 10*a* is not limited to this. For example, only a printing method or a sheet stacking method can be used. Furthermore, the electronic component 10*a* can be manufactured using a transcription method. In this case, a plurality of stacks in which the magnetic layers 16, the coil electrodes 18, and the nonmagnetic layers 20 and 22 are stacked are formed on a film in advance, and these formed layers are sequentially stacked through transcription, whereby the stack 12 can be manufactured.

The present invention is useful for electronic components, and provides an advantage in that an inductance which changes in accordance with the magnitude of a current is obtained, and an abrupt decrease in inductance due to magnetic saturation is suppressed.

Embodiments consistent with the claimed invention can facilitate improving the DC superposition characteristics of the electronic component because the second insulator layer that has a permeability lower than that of the first insulator layers is arranged to cut across the coil. Additionally, an inductance which changes in accordance with the magnitude of a current can be obtained because the structure of the third insulator layer on the upper side of the second insulator layer in the stacking direction is different from the structure of the third insulator layer on the lower side of the second insulator layer in the stacking direction.

Although a limited number of exemplary embodiments of the invention have been described above, it is to be understood that variations and modifications will be apparent to those skilled in the art without departing from the scope and spirit of the invention. The scope of the invention, therefore, is to be determined solely by the following claims and their equivalents.

The invention claimed is:

1. An electronic component comprising, a stack of a plurality of first insulator layers;

a plurality of coil electrodes connected to one another in the stack to form a coil;

a second insulator layer that is arranged in such a manner as to cut across the coil and that has a permeability lower than that of the first insulator layers; and a third insulator layer that is, when viewed in a stacking direction, formed in a region outside of a region in which the coil is formed, and that has a permeability lower than that of the first insulator layers, wherein a structure of the third insulator layer on the upper side of the second insulator layer in the stacking direction is different from a structure of the third insulator layer on the lower side of the second insulator layer in the stacking direction, and a direct-current superposition characteristic of a portion of the coil on the upper side of the second insulator layer in the stacking direction is different from a direct-current superposition characteristic of a portion of the coil on the lower side of the second insulator layer in the stacking direction.

2. The electronic component according to claim 1, wherein the third insulator layer is, when viewed in the stacking direction, provided in a region which overlaps the coil electrodes and in the region outside of the region in which the coil is provided.

3. The electronic component according to claim 2, wherein the second insulator layer and the third insulator layer are nonmagnetic layers.

4. The electronic component according to claim 2, wherein the third insulator layer is not provided on an upper side of the second insulator layer in the stacking direction, and wherein the third insulator layer is provided on a lower side of the second insulator layer in the stacking direction.

5. The electronic component according to claim 3, wherein the third insulator layer is not provided on an upper side of the second insulator layer in the stacking direction, and wherein the third insulator layer is provided on a lower side of the second insulator layer in the stacking direction.

6. The electronic component according to claim 1, wherein the second insulator layer and the third insulator layer are nonmagnetic layers.

7. The electronic component according to claim 6, wherein the third insulator layer is not provided on an upper side of the second insulator layer in the stacking direction, and wherein the third insulator layer is provided on a lower side of the second insulator layer in the stacking direction.

8. The electronic component according to claim 1, wherein the third insulator layer is not provided on an upper side of the second insulator layer in the stacking direction, and wherein the third insulator layer is provided on a lower side of the second insulator layer in the stacking direction.

9. The electronic component according to claim 1, wherein the second insulating layer extends across a portion an interior area of the coil when viewed in the stacking direction.

10. The electronic component according to claim 9, wherein the third insulating layer does not overlap the portion of second insulating layer extending in the interior area of the coil when viewed in the stacking direction.

* * * * *